US009404632B2

(12) United States Patent
Ovenshire et al.

(10) Patent No.: US 9,404,632 B2
(45) Date of Patent: Aug. 2, 2016

(54) LENS ASSEMBLY FOR A VEHICLE

(71) Applicant: GM GLOBAL TECHNOLOGY OPERATIONS LLC, Detroit, MI (US)

(72) Inventors: Jay H. Ovenshire, Rochester, MI (US); Martin J. Davis, Royal Oak, MI (US); Benjamin P. Zavala, Cincinnati, OH (US)

(73) Assignee: GM Global Technology Operations LLC, Detroit, MI (US)

( * ) Notice: Subject to any disclaimer, the term of this patent is extended or adjusted under 35 U.S.C. 154(b) by 106 days.

(21) Appl. No.: 14/310,578

(22) Filed: Jun. 20, 2014

(65) Prior Publication Data

US 2015/0369441 A1 Dec. 24, 2015

(51) Int. Cl.
*F21S 8/10* (2006.01)

(52) U.S. Cl.
CPC ..... *F21S 48/2206* (2013.01); *F21S 48/2212* (2013.01); *F21S 48/2237* (2013.01); *F21S 48/2243* (2013.01)

(58) Field of Classification Search
CPC ..... B60Q 1/0011; B60Q 1/22; B60Q 1/26; B60Q 1/30; B60Q 1/34; B60Q 1/2619; F21S 48/1241; F21S 48/2225; F21S 48/2206; F21S 48/2212; F21S 48/2237; F21S 48/2243; G02B 6/0076; G02B 6/0058
USPC ..... 362/268, 331, 337, 339, 507, 509, 511, 362/520, 521, 522, 538–539, 543, 545, 362/600–634
See application file for complete search history.

(56) References Cited

U.S. PATENT DOCUMENTS 4,293,892 A * 10/1981 Plummer ..... F21S 48/1721 362/17
4,652,979 A * 3/1987 Arima ..... F21S 48/2212 362/268
5,580,165 A * 12/1996 Natsume ..... F21S 48/2212 362/309
8,029,160 B2 * 10/2011 Kuo ..... F21S 48/10 362/268
2009/0262546 A1 * 10/2009 Stefanov ..... F21S 48/1154 362/507
2009/0290336 A1 * 11/2009 Senzaki ..... F21V 5/04 362/231
2010/0124073 A1 * 5/2010 Kowalczyk ..... B60Q 1/2607 362/545
2010/0135023 A1 * 6/2010 Heise ..... F21V 5/04 362/281
2012/0098875 A1 * 4/2012 Shinkai ..... G02B 6/0036 345/690
2015/0036373 A1 * 2/2015 Chen ..... F21S 48/12 362/516

* cited by examiner

*Primary Examiner* — Evan Dzierzynski
*Assistant Examiner* — Zheng Song
(74) *Attorney, Agent, or Firm* — Quinn Law Group, PLLC

(57) ABSTRACT

A lens assembly for a vehicle includes a light source, a preliminary lens, and a bending lens. The light source emits a stream of light rays. The preliminary lens has an entry surface and an exit surface disposed opposite the entry surface. The preliminary lens is disposed in adjacent relationship to the light source such that the entry surface faces the light source. The bending lens has a receptor surface and an emission surface disposed opposite the receptor surface. The receptor surface of the bending lens faces the exit surface of the preliminary lens. At least one optic extends from the emission surface of the bending lens. Each optic is configured to bend a portion of the stream of parallel light rays travelling therethrough such that a stream of bent light rays is emitted from the optic.

18 Claims, 2 Drawing Sheets

LENS ASSEMBLY FOR A VEHICLE

TECHNICAL FIELD

The present disclosure is related to a lens assembly for a vehicle.

BACKGROUND

Vehicles include exterior lights, including tail lights, turn signals, rear fog lamps, a center high mount stop light (CHMSL), and the like. These exterior lights are configured to be illuminated to make the vehicle visible.

SUMMARY

A lens assembly for a vehicle includes a light source, a preliminary lens, and a bending lens. The light source is configured to emit a stream of light rays. The preliminary lens has an entry surface and an exit surface disposed opposite the entry surface. The preliminary lens is disposed in adjacent relationship to the light source such that the entry surface faces the light source. The entry surface is configured to receive at least a portion of the stream of light rays. The preliminary lens is configured to straighten the stream of light rays and emit a stream of parallel light rays through the exit surface. The bending lens has a receptor surface and an emission surface disposed opposite the receptor surface. The bending lens is disposed in spaced and adjacent relationship to the preliminary lens such that the receptor surface faces the exit surface of the preliminary lens. The receptor surface is configured to receive at least a portion of the stream of parallel light rays. At least one optic extends from the emission surface of the bending lens. Each optic is configured to bend a portion of the stream of parallel light rays travelling therethrough such that a stream of bent light rays is emitted from the optic.

In another aspect of the disclosure, a tail light assembly is provided for a vehicle. The tail light assembly includes a bezel, a housing, and a lens assembly. The lens assembly is configured to be supported between the bezel and the housing. The lens assembly includes a light source, a preliminary lens, and a bending lens. The light source is configured to emit a stream of light rays. The preliminary lens has an entry surface and an exit surface disposed opposite the entry surface. The preliminary lens is disposed in adjacent relationship to the light source such that the entry surface faces the light source. The entry surface is configured to receive at least a portion of the stream of light rays. The preliminary lens is configured to straighten the stream of light rays and emit a stream of parallel light rays through the exit surface. The bending lens has a receptor surface and an emission surface disposed opposite the receptor surface. The bending lens is disposed in spaced and adjacent relationship to the preliminary lens such that the receptor surface faces the exit surface of the preliminary lens. The receptor surface is configured to receive at least a portion of the stream of parallel light rays. At least one optic extends from the emission surface of the bending lens. Each optic is configured to bend a portion of the stream of parallel light rays travelling therethrough such that a stream of bent light rays is emitted from the optic.

In yet another aspect of the disclosure, a vehicle is provided. The vehicle includes a body panel and a tail light assembly. The tail light assembly is operatively attached to the body panel. The tail light assembly includes a bezel, a housing, and a lens assembly. The lens assembly is configured to be supported between the bezel and the housing. The lens assembly includes a light source, a preliminary lens, and a first, a second, and a third bending lens. The light source is configured to emit a stream of light rays. The preliminary lens has an entry surface and an exit surface disposed opposite the entry surface. The preliminary lens is disposed in adjacent relationship to the light source such that the entry surface faces the light source. The entry surface is configured to receive at least a portion of the stream of light rays. The preliminary lens is configured to straighten the stream of light rays and emit a stream of parallel light rays through the exit surface. Each of the first bending lens, the second bending lens, and the third bending lens has a receptor surface and an emission surface disposed opposite the receptor surface. The first bending lens is disposed in spaced and adjacent relationship to the preliminary lens such that the receptor surface faces the exit surface of the preliminary lens. The second bending lens is disposed in spaced and adjacent relationship to the first bending lens such that the receptor surface of the second bending lens faces the emission surface of the first bending lens. The third bending lens is disposed in spaced and adjacent relationship to the second bending lens such that the receptor surface of the third bending lens faces the emission surface of the second bending lens. At least one optic extends from the emission surface of each of the first, second, and third bending lenses. Each optic, of each of the first, second, and third bending lens, is configured to bend a portion of the stream of parallel light rays travelling therethrough such that a stream of bent light rays is emitted from the optic.

The above features and advantages and other features and advantages of the present teachings are readily apparent from the following detailed description of the best modes for carrying out the present teachings when taken in connection with the accompanying drawings.

DETAILED DESCRIPTION

Figure 1:
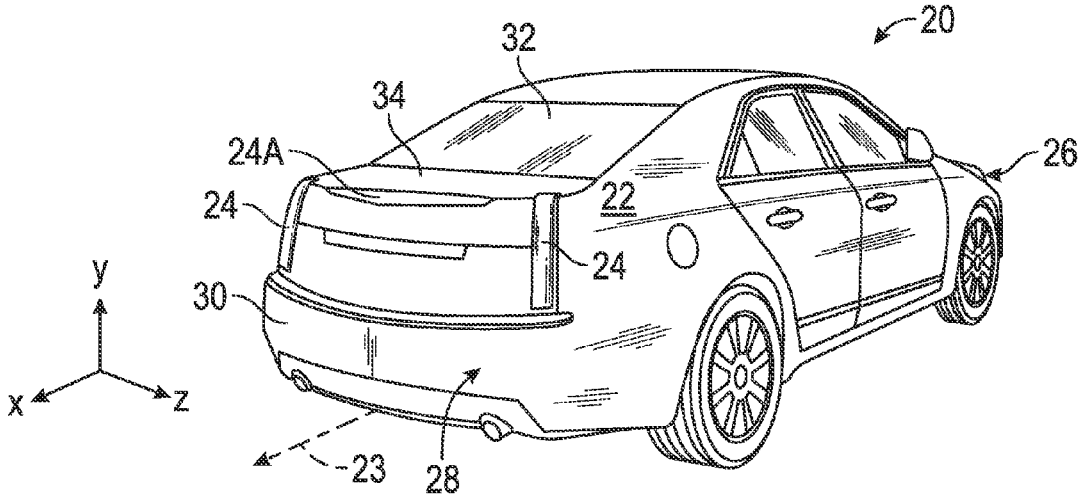
FIG. 1 is a schematic perspective view illustration of an example vehicle having tail light assembly as described herein.

Referring to the drawings, wherein like reference numbers refer to the same or like components in the several Figures, and beginning with FIG. 1, an example vehicle 20 includes a body 22 and a plurality of external vehicle lighting assemblies, each positioned with respect to the body 22. The body 22 extends along a longitudinal axis 23, i.e., in an x direction, between a forward end 26 and a rearward end 28 of the vehicle 20. The lighting assemblies include a set of tail light assemblies 24. One or more additional tail light assemblies 24A may be positioned at a rear 30 of the vehicle 20 for added visibility, for instance above or below a rear window 32 or adjacent to a trunk lid 34, with the latter example shown in FIG. 1.

Those having ordinary skill in the art will recognize that terms such as "above," "below," "upward," "downward," "top," "bottom," etc., are used descriptively for the figures, and do not represent limitations on the scope of the invention, as defined by the appended claims. Furthermore, the invention may be described herein in terms of functional and/or logical block components and/or various processing steps. It should be realized that such block components may be comprised of any number of hardware, software, and/or firmware components configured to perform the specified functions.

Figure 2:
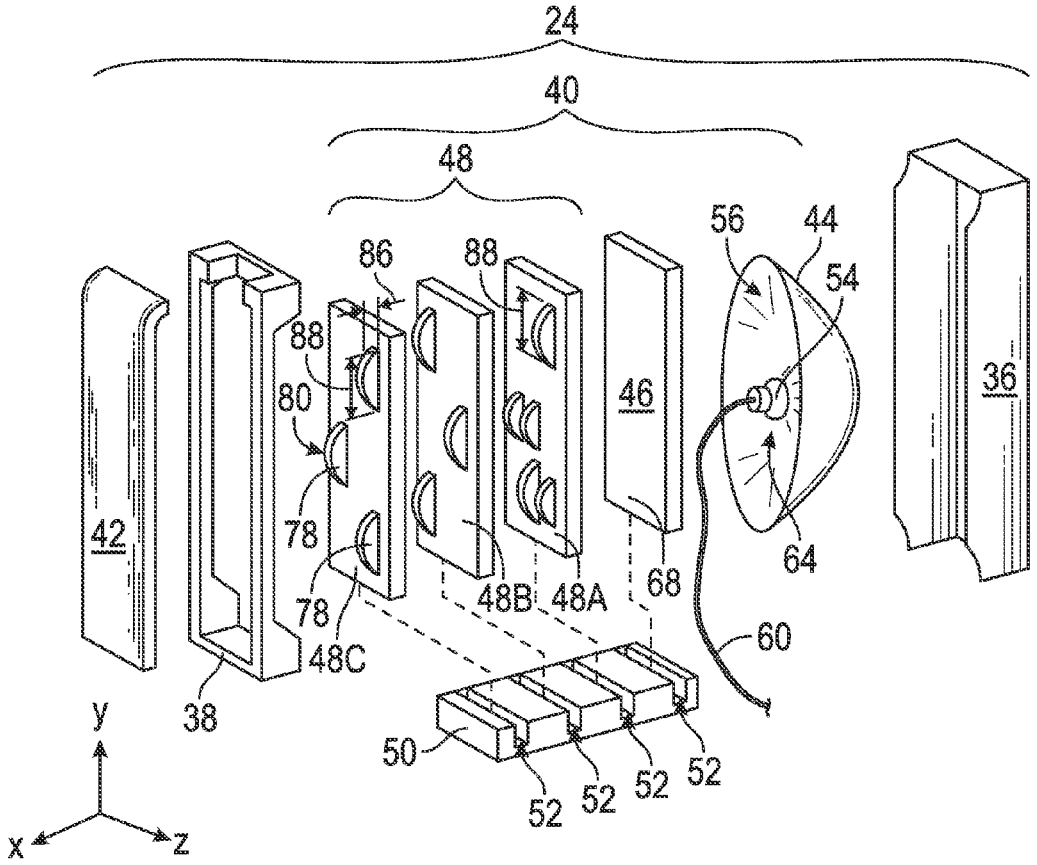
FIG. 2 is a schematic exploded view illustration of the tail light assembly shown in FIG. 1

Referring to FIG. 2, each tail light assembly includes a housing 36, a bezel 38, a lens assembly 40, and an outer lens 42. The housing 36 is constructed of a suitable material such as plastic or metal. The housing 36 is configured to be attached to the bezel 38 such that the lens assembly 40 is sandwiched between the bezel 38 and the housing 36.

With continued reference to FIG. 2, the bezel 38 may support the outer lens 42. All of the internal components of the tail light assembly may be received within the bezel 38 and/or the housing 36, where the bezel 38 may be constructed of plastic or another suitable material. Therefore, the outer lens 42 and the housing 36 contain the various components therein, with the bezel 38 positioned adjacent to the outer lens 42.

The lens assembly 40 includes a light source 44, a preliminary lens 46, and a bending lens 48. The outer lens 42 is typically constructed of colored transparent or translucent plastic, which may be red in color. However, it should be appreciated that the outer lens 42 may be constructed out of materials having different colors and/or materials. The outer lens 42 may be configured to cover the housing 36 such that the housing 36 and the outer lens 42 encapsulate, i.e., fully surrounds and encloses the light source 44, the preliminary lens 46, and the bending lens 48.

With continued reference to FIG. 2, the light source 44 is configured to emit a stream of light rays 58. The light source 44 includes a light bulb 54 and a reflection surface 56. The light bulb 54 may be a filament type light bulb 54, such as an incandescent light bulb, and the like, that emits a plurality of light rays 58 in an x, y, and/or z direction. A wire 60 may be operatively attached to the light bulb 54 to selectively provide an electrical signal to selectively illuminate the light bulb 54, such as in response to actuation of a device, e.g., a turn signal switch, a brake pedal switch, and the like.

Figure 3:
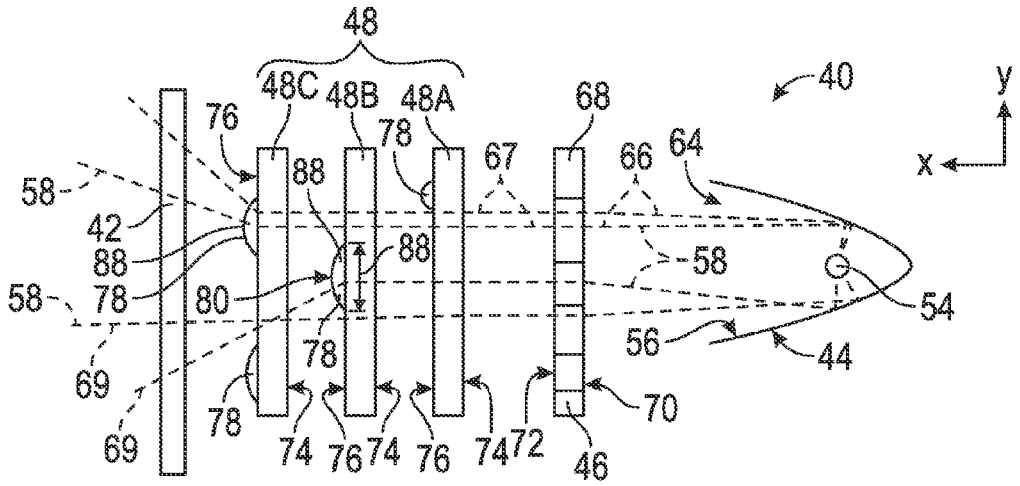
FIG. 3 is a schematic illustrative side view of a lens assembly of the tail light assembly, illustrating several light rays travelling therethrough.

The reflection surface 56 may be a parabolic-shaped dish having a reflection surface 56 that defines a reflection cavity 64. The light bulb 54 is operatively disposed in the reflection cavity 64 such that light rays 58 emitted from the light bulb 54 are directed toward the reflection surface 56. Referring now to FIGS. 2 and 3, once the light rays 58 contact the reflection surface 56, the light rays 58 scatter in any of the x, y, and/or z directions, according to Snell's law. As explained in more detail below, the preliminary lens 46 is operatively disposed adjacent the light source 44. The reflection surface 56 generally faces the preliminary lens 46 such that the scattered light rays 66 are directed as a stream of parallel light rays 67, toward the preliminary lens 46. For simplicity, FIGS. 2 and 3 each only illustrate four light rays 58 being emitted from the light bulb 54 of the light source 44. However, it should be appreciated that, in reality, a stream of light is not really confined to a finite number of narrow lines, as a theoretically infinite number of light rays 58 will diverge from the light bulb 54.

The preliminary lens 46 is a filter that is configured to straighten the scattered light rays 66 received from the light source 44. The preliminary lens 46 may be a collimator 68 configured to align the stream of light rays 58 received from the light source 44 such that the stream of scattered light rays 66 travelling in the x, y, and/or z direction become a stream of parallel light rays 67 that travel in only the x direction. The preliminary lens 46 includes an entry surface 70 and an exit surface 72 disposed opposite the entry surface 70. The entry surface 70 is disposed in facing relationship to the light source 44 and the exit surface 72 is disposed in facing relationship to the bending lens 48. Therefore, the light rays 58 exit the preliminary lens 46 through the exit surface 72, in parallel relationship to one another, and travel in only the x direction.

The bending lens 48 may be formed from a transparent material such as a polycarbonate, acrylic, and/or the like. The bending lens 48 includes a receptor surface 74 and an emission surface 76, disposed opposite the receptor surface 74. Referring to FIGS. 2 and 3, the bending lens 48 may be a plurality of bending lenses 48, i.e., a first bending lens 48A, a second bending lens 48B, and a third bending lens 48C disposed in adjacent and stacked relationship to one another. The first bending lens 48A is disposed adjacent the preliminary lens 46. The second bending lens 48B is disposed adjacent the first bending lens 48A such that the first bending lens 48A is disposed between the preliminary lens 46 and the second bending lens 48B. The third bending lens 48C is disposed adjacent the second bending lens 48B such that the second bending lens 48B is disposed between the first bending lens 48A and the third bending lens 48C. In this arrangement, and as will be explained in more detail below, parallel light rays 67 received from the exit surface 72 of the preliminary lens 46 are sequentially directed through the first, second, and third bending lenses 48A, 48B, 48C.

Referring again to FIG. 2, the lens assembly 40 may also include a tray 50 configured for operatively supporting the preliminary lens 46 and the bending lenses 48A-C. The tray 50 is configured to maintain the lenses 46, 48A-C in relationship to one another. By way of a non-limiting example, the tray 50 may define a plurality of slots 52, where each slot is configured for receiving a respective lens therein.

Figure 4:
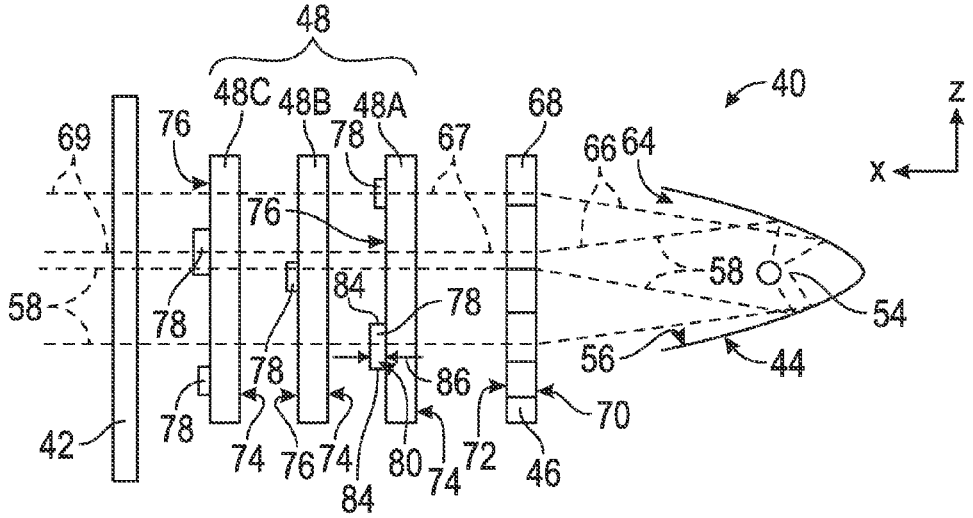
FIG. 4 is a schematic illustrative top view of the lens assembly of the tail light assembly, illustrating several light rays travelling therethrough.

Referring to FIGS. 2-4, at least optic 78 extends from the emission surface 76 of each bending lens 48. The optic 78 is configured to change an angle of the light ray 58 being received through the receptor surface 74. More specifically, the optic 78 is configured to bend the light ray 58 travelling through the respective bending lens 48A-C, to travel in an xy direction. More specifically, as illustrated in FIG. 3, the preliminary lens 46 directs the light rays 58 to travel, in parallel relationship to one another, in the x direction. The stream of parallel light rays 67, received from the preliminary lens 46, enters the bending lens 48 through the receptor surface 74. Some of those parallel light rays 67 encounter an optic 78 disposed on the emission surface 76, which subsequently causes those light rays 58 to bend to subsequently travel in the xy direction of travel. More specifically, these light rays 58, which enter the first bending lens 48A in parallel relationship with one another, are bent by the optic 78 to change direction from only travelling in the x direction to subsequently travel in the xy direction as a stream of bent light rays 69. These light rays 58 may continue to travel through each of any subsequent bending lenses 48A-C and exit through the outer lens 42. While three bending lenses 48A-C are illustrated in the Figures, it should be appreciated that any number of bending lenses 48 may be provided in the lens assembly 40.

Referring again to FIG. 2, the optic 78 includes a dispersion surface 80 configured to change the direction of travel of the light rays 58 being received through the receptor surface 74. The dispersion surface 80 and the emission surface 76 of the bending lens 48 are non-planar. The dispersion surface 80 extends as an arch 82 from the emission surface 76. More specifically, each optic 78 includes a pair of walls 84 extending a height 86 from the emission surface 76 in spaced relationship to one another. The dispersion surface 80 extends between the walls 84 and the emission surface 76. As such, the optic 78 may be hump shaped. The optics 78 may be equally sized. Alternatively, the optics 78 may have different sizes to produce differing degrees of bending of the light rays 58 traveling therethrough. Further, the walls 84 extend a length 88 along the emission surface 76. The walls 84 for each optic 78 may have different heights 86 and different lengths 88. The differing heights 86 and lengths 88 of the walls 84 affect the shape of the arch 82, thus also changing the scattered geometry of the light rays 58 travelling therethrough. Further, the walls 84 may be configured to extend in generally perpendicular relationship between the emission surface 76 and the dispersion surface 80, i.e., in generally parallel relationship with the x direction. As such, the light rays 58 travelling through the optic 78 are only directed to travel in the xy direction, and would not be directed in the z direction.

Referring to FIGS. 2-4, it should be appreciated that a plurality of optics 78 may be disposed on each bending lens 48A-C. Further, the optics 78 on one bending lens 48 may be placed such that the stream of bent light rays 69, that were bent from an optic 78 on a preceding bending lens 48, do not enter the subsequent optic. The optics 78 are arranged on the bending lenses 48 to provide a scattered geometry of the light rays 58 in the xy direction, as viewed from outside the trail light assembly 24. As such, the optics 78 may be specifically sized and arranged so as to provide a three-dimensional like image that may be discernible from a rear 30 of the vehicle 20, i.e., when looking at the outer lens 42, from the rear 30 of the vehicle 20, in the x direction. However, when the vehicle 20 is viewed from any other orientation, while light rays 58 may be visible, the specific image would not be discernible. This image is the result of progression lighting, i.e., a culmination of the light rays 58 progressing through each of the lenses 46, 48, 42.

While FIGS. 3 and 4 illustrate directing scattered light rays 66 to only travel in parallel in the x direction of travel, as a result of the preliminary lens 46, and then to only travel in the xy direction of travel, as a result of the bending lenses 48A-C, it should be appreciated that the lenses 46, 48 may be arranged so as to provide the bending of light to travel in any desired direction of travel to provide any desired image from any desired vantage point, with respect to the tail light assembly 24.

Referring again to FIG. 2, each optic 78 and the respective bending lens 48 may be integrally formed. Alternatively, each optic 78 may be operatively attached to the emission surface 76 of the bending lens 48, e.g., via an adhesive, and the like. Further, the emission surface 76 may be generally planar such that light rays 58 travelling through the respective bending lens 48 are not bent by the emission surface 76 and only bent by travelling through the optics 78.

Figure 5:
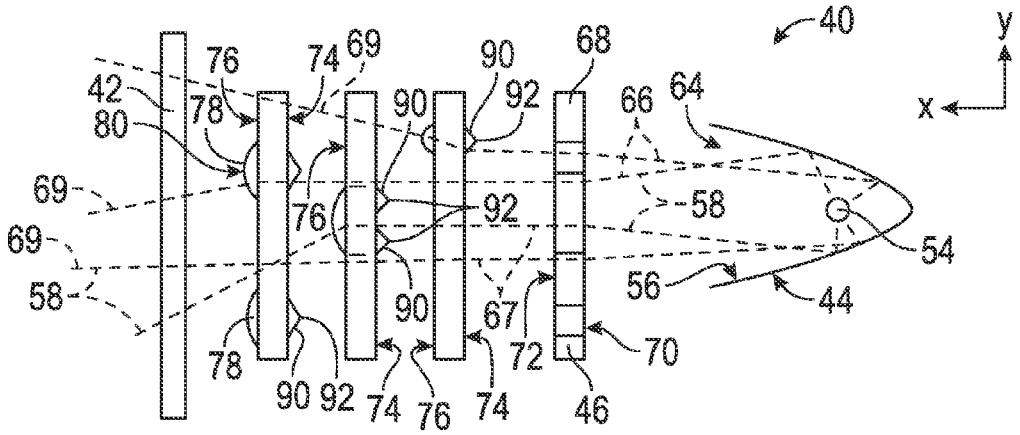
FIG. 5 is a schematic illustrative side view of another embodiment of the lens assembly of the tail light assembly, illustrating several light rays travelling therethrough.

In another embodiment, shown in FIG. 5, at least one node 90 may be disposed on the receptor surface 74. The nodes 90 may extend from the receptor surface 74 to an apex 92. As such, each node 90 is generally triangular, i.e., saw-toothed, in shape. The nodes 90 are configured to interrupt the light rays 58 received from the preceding lens and redirect the light rays 58 toward the optic 78 disposed on the dispersion surface 80, opposite the receptor surface 74. Such nodes 90 may be used to increase a number of light rays 58 being directed through the respective optic 78.

While the best modes for carrying out the many aspects of the present teachings have been described in detail, those familiar with the art to which these teachings relate will recognize various alternative aspects for practicing the present teachings that are within the scope of the appended claims.

The invention claimed is:

1. A lens assembly for a vehicle, the lens assembly comprising:

a light source configured to emit a stream of scattered light rays;

a preliminary lens having an entry surface and an exit surface disposed opposite the entry surface;

wherein the preliminary lens is disposed in adjacent relationship to the light source such that the entry surface faces the light source and is configured to receive at least a portion of the stream of light rays;

wherein the preliminary lens is configured to straighten the stream of light rays and emit a stream of parallel light rays through the exit surface;

a plurality of bending lenses disposed in spaced and adjacent relationship to one another;

wherein each of the plurality of bending lenses includes a receptor surface and an emission surface disposed opposite the receptor surface;

wherein one of the plurality of bending lenses is disposed in spaced and adjacent relationship to the preliminary lens such that the receptor surface of the one of the plurality of bending lenses faces the exit surface of the preliminary lens;

wherein the receptor surface of each of the plurality of bending lenses is configured to receive at least a portion of the stream of parallel light rays; and at least one optic extending from the emission surface of each of the plurality of bending lenses, such that the light refracted therethrough does not enter the at least one optic of the subsequent bending lenses;

wherein the at least one optic is configured to bend a portion of the stream of light rays travelling therethrough such that a stream of bent light rays are emitted from the optic.

2. A lens assembly, as set forth in claim 1, wherein the preliminary lens is a collimator configured to straighten the stream of light rays emitted from the light source to emit the stream of parallel light rays through the exit surface.

3. A lens assembly, as set forth in claim 1, wherein the optic is hump shaped.

4. A lens assembly, as set forth in claim 3, wherein the at least one optic includes a dispersion surface configured to bend a portion of the stream of parallel light rays travelling therethrough such that a stream of bent light rays are emitted from the optic;

wherein the dispersion surface and the emission surface of the bending lens are non-planar.

5. A lens assembly, as set forth in claim 4, wherein the dispersion surface extends as an arch from the emission surface.

6. A lens assembly, as set forth in claim 5, wherein the at least one optic includes a pair of walls extending from the emission surface in spaced relationship to one another and the dispersion surface extends between the walls and the emission surface.

7. A lens assembly, as set forth in claim 6, wherein the walls extend between the emission surface and the dispersion surface such that the walls are in generally perpendicular relationship to the emission surface.

8. A lens assembly, as set forth in claim 1, wherein the at least one optic and the bending lens are integrally formed.

9. A lens assembly, as set forth in claim 1, wherein the at least one optic is operatively attached to the emission surface of the bending lens.

10. A lens assembly, as set forth in claim 1, wherein the emission surface is generally planar.

11. A lens assembly, as set forth in claim 1, wherein the at least one optic is further defined as a plurality of optics.

12. A tail light assembly for a vehicle, the tail light assembly comprising:

a bezel;

a housing; and a lens assembly configured to be supported between the bezel and the housing, the lens assembly including:

a light source configured to emit a stream of light rays;

a preliminary lens having an entry surface and an exit surface disposed opposite the entry surface;

wherein the preliminary lens is disposed in adjacent relationship to the light source such that the entry surface faces the light source and is configured to receive at least a portion of the stream of light rays;

wherein the preliminary lens is configured to straighten the stream of light rays and emit a stream of parallel light rays through the exit surface;

a plurality of bending lenses disposed in spaced and adjacent relationship to one another;

wherein each of the plurality of bending lenses includes a receptor surface and an emission surface disposed opposite the receptor surface;

wherein one of the plurality of bending lenses is disposed in spaced and adjacent relationship to the preliminary lens such that the receptor surface of the one of the plurality of bending lenses faces the exit surface of the preliminary lens;

wherein the receptor surface of each of the plurality of bending lenses is configured to receive at least a portion of the stream of parallel light rays; and at least one optic extending from the emission surface of each of the plurality of bending lenses, such that the light refracted therethrough does not enter the at least one optic of the subsequent bending lenses;

wherein the at least one optic is configured to bend a portion of the stream of light rays travelling therethrough such that a stream of bent light rays are emitted from the optic.

13. A tail light assembly, as set forth in claim 12, further comprising an outer lens configured to cover the bezel such that the outer lens, the bezel, and the housing encapsulates the lens assembly;

wherein the stream of bent light rays travel through the outer lens.

14. A tail light assembly, as set forth in claim 12, wherein the lens assembly further includes a tray configured for operatively supporting the preliminary lens and the bending lens relative to each other.

15. A tail light assembly, as set forth in claim 12, wherein the preliminary lens is a collimator configured to straighten the stream of light rays emitted from the light source to emit the stream of parallel light rays through the exit surface.

16. A lens assembly, as set forth in claim 12, wherein the optic is hump shaped.

17. A vehicle comprising:

a body panel; and a tail light assembly operatively attached to the body panel, wherein the tail light assembly includes:

a bezel;

a housing; and a lens assembly configured to be supported between the bezel and the housing, the lens assembly including:

a light source configured to emit a stream of scattered light rays;

a preliminary lens having an entry surface and an exit surface disposed opposite the entry surface;

wherein the preliminary lens is disposed in adjacent relationship to the light source such that the entry surface faces the light source and is configured to receive at least a portion of the stream of light rays;

wherein the preliminary lens is configured to straighten the stream of light rays and emit a stream of parallel light rays through the exit surface;

a first bending lens, a second bending lens, and a third bending lens, wherein each of the first, second, and third bending lenses has a receptor surface and an emission surface disposed opposite the receptor surface;

wherein the first bending lens is disposed in spaced and adjacent relationship to the preliminary lens such that the receptor surface faces the exit surface of the preliminary lens;

wherein the second bending lens is disposed in spaced and adjacent relationship to the first bending lens such that the receptor surface of the second bending lens faces the emission surface of the first bending lens;

wherein the third bending lens is disposed in spaced and adjacent relationship to the second bending lens such that the receptor surface of the third bending lens faces the emission surface of the second bending lens; and at least one optic extending from the emission surface of each of the first, second, and third bending lens, such that the light refracted therethrough does not enter the at least one optic of the subsequent bending lens;

wherein the at least one optic of each of the first, second, and third bending lens is configured to bend a portion of the stream of parallel light rays travelling therethrough such that a stream of bent light rays are emitted from the optic.

18. A vehicle, as set forth in claim 17, wherein the preliminary lens is a collimator configured to straighten the stream of light rays emitted from the light source to emit a stream of parallel light rays through the exit surface.

* * * * *